US006029642A

United States Patent [19]

Wild et al.

[11] Patent Number: 6,029,642

[45] Date of Patent: Feb. 29, 2000

[54] METHOD FOR FORMING A FUEL-METERING SIGNAL FOR AN INTERNAL COMBUSTION ENGINE

[75] Inventors: Ernst Wild, Oberriexingen; Klaus Joos, Walheim; Werner Mezger, Eberstadt; Klaus Hirschmann, Leonberg; Thomas Oelker, Muehlacker; Nikolaus Benninger, Vaihingen; Werner Hess, Stuttgart; Christian Tischer, Hemmingen; Georg Mallebrein, Singen, all of Germany

[73] Assignee: Robert Bosch GmbH, Stuttgart, Germany

[21] Appl. No.: 09/200,967

[22] Filed: Nov. 30, 1998

[30] Foreign Application Priority Data

Dec. 6, 1997 [DE] Germany ..... 197 54 218

[51] Int. Cl.[7] ..... F02D 41/00

[52] U.S. Cl. ..... 123/681; 123/682; 123/685; 201/103; 201/109

[58] Field of Search ..... 701/109, 103, 701/104; 123/681, 682, 685

[56] References Cited

U.S. PATENT DOCUMENTS 5,781,875 7/1998 Maki et al. ..... 701/104
5,908,463 6/1999 Akazaki et al. ..... 701/104

FOREIGN PATENT DOCUMENTS 0533495 3/1993 European Pat. Off. .
2084353 4/1982 United Kingdom .

*Primary Examiner*—Erick R. Solis
*Attorney, Agent, or Firm*—Walter Ottesen

[57] ABSTRACT

The invention is directed to a method for computing a fuel-metering signal for adjusting a pregiven lambda value for the composition of the air/fuel mixture of an internal combustion engine. In the method, a first signal is formed which represents the air quantity flowing into the engine and a second signal is formed on the basis of the first signal so that a first lambda desired value adjusts when using its second signal as a fuel-metering signal. Various additional second lambda desired values are formed as a function of operating parameters of the engine. A selection is made of those second lambda desired values having the highest priority and the fuel-metering signal is formed by weighting the second signal with the second lambda desired value of the highest priority.

6 Claims, 3 Drawing Sheets

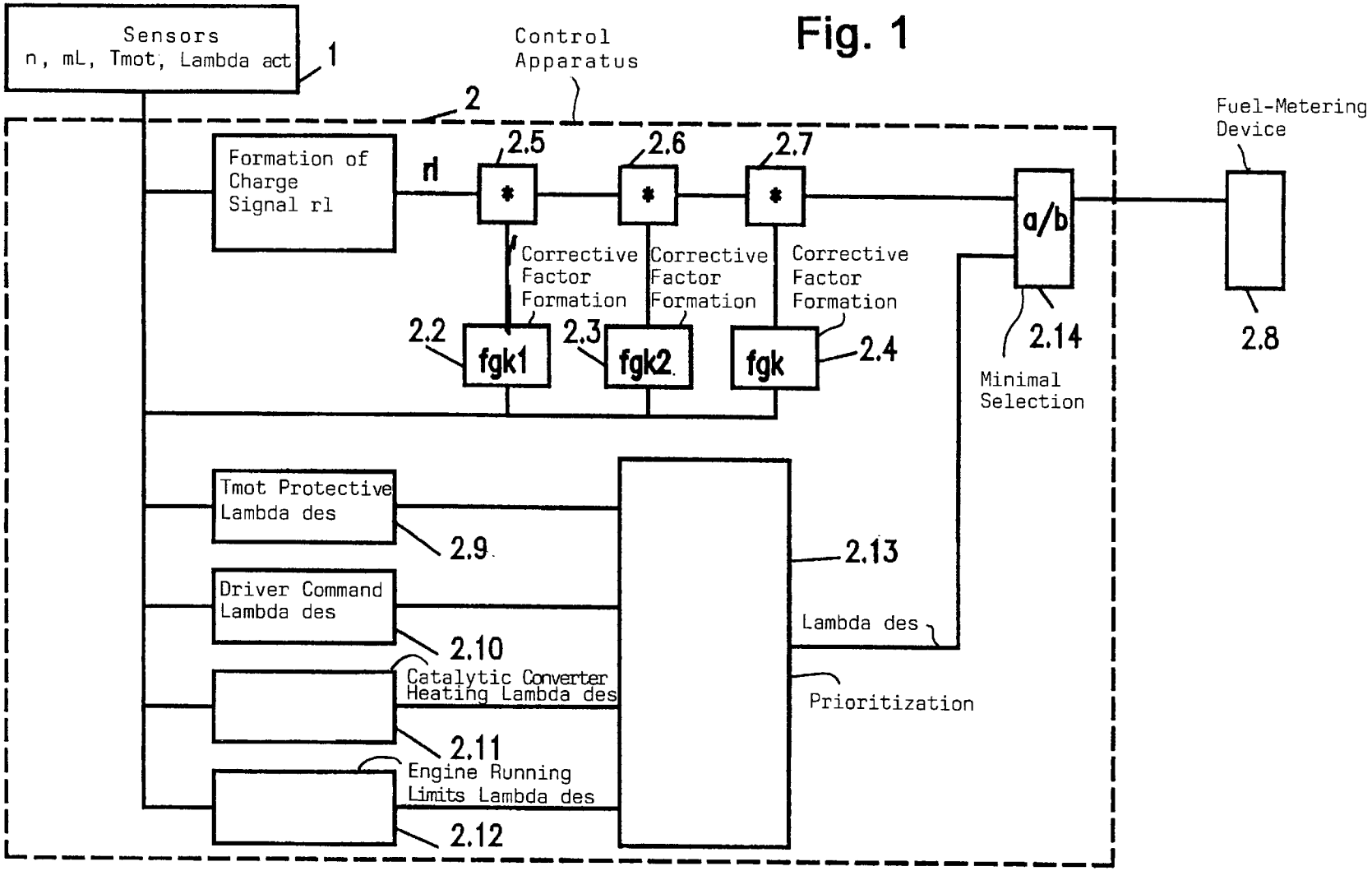
Fig. 1
Fuel-Metering Device
2.8
a/b
2.14
Minimal Selection
Lambda des
Prioritization
2.13
Corrective Factor Formation
2.4
fgk
2.7
*
Corrective Factor Formation
fgk2
2.6
*
Corrective Factor Formation
2.3
fgk1
2.5
*
2.2
rl
Control Apparatus
2
Formation of Charge Signal rl
Sensors
n, mL, Tmot, Lambda act
1
Tmot Protective Lambda des
2.9
Driver Command Lambda des
2.10
Catalytic Converter Heating Lambda des
2.11
Engine Running Limits Lambda des
2.12

Lambda des
Limit Resulting Lambda Command to Region within Engine Running Limits
2.16
2.15
Catalytic Converter Heating Strategy
2.14
Minimal Selection
2.13
Prioritization
Catalytic Converter Heating Lambda des
Lambda max
Tmot Protective Lambda des
Driver Command Lambda des
Lambda min
2.12
2.9
2.10
2.11
2.12

METHOD FOR FORMING A FUEL-METERING SIGNAL FOR AN INTERNAL COMBUSTION ENGINE

BACKGROUND OF THE INVENTION

In the formation of a fuel-metering signal, it is known to compute a base value of a fuel-metering signal from signals for the rpm and the intake-air quantity of the engine. This base value is corrected with further corrective quantities for adapting to operating conditions such as restart, warm running, acceleration, full load, et cetera. Additional corrections can, for example, result from requirements of overheating protective measures, knock-protective measures or even for catalytic converter heating measures. With an increasing number of corrective interventions, the probability increases that unwanted cumulative effects of simultaneous corrective interventions occur. For example, a cumulative enrichment because of knock protection, warm-up running and full load could effect an enrichment which exceeds the actual requirement. In the same way, corrections which effect a leaning (corrections, which are, for example, used for heating catalytic converters) can compensate in an unwanted manner with the above-mentioned enriching operating quantities.

SUMMARY OF THE INVENTION

It is an object of the invention to further optimize the formation of a fuel-metering signal and to avoid the above-mentioned disadvantages.

The method of the invention is for computing a fuel-metering signal for adjusting a pregiven lambda value for the composition of the air/fuel mixture of an internal combustion engine. The method of the invention includes the steps of: forming a first signal which represents the air quantity flowing into the engine; forming a second signal on the basis of the first signal so that a first lambda desired value adjusts when using the second signal as a fuel-metering signal; forming various additional second lambda desired values as a function of operating parameters of the engine; making a selection of those second lambda desired values having the highest priority; and, forming the fuel-metering signal by weighting the second signal with the second lambda desired value of the highest priority.

The invention distinguishes between the formation of a preliminary fuel-metering signal and the formation of a final valid fuel-metering signal. The preliminary fuel-metering signal is formed in such a manner that a first lambda desired value would adjust with the use of this signal. This first lambda desired value is preferably $\lambda=1$. In the formation of this signal, mixture corrective factors and corrections are included in the computation. The mixture corrective factors are for considering wall film effects for injection into the intake manifold and the corrections serve (for intake manifold direct injection as well as for gasoline direct injection) for avoiding incomplete combustions during warm-up running and restarting. The final valid fuel-metering signal is formed from this preliminary signal via a weighted logic coupling to a further lambda desired value which is formed in dependence upon operating states and can deviate from $\lambda=1$.

An essential element of the invention lies in the selection of the additional lambda desired value from several lambda desired value requirements (as may be required) from different engine control functions. According to a feature of the invention, a priority control selects the most important command and the mixture is corrected therewith.

The division into mixture corrections and lambda desired values makes a purposeful mixture adjustment possible in an advantageous manner even when several competing lambda desired value commands are present. Modern control apparatus utilize the relationship between the torque, which is developed by the engine, and the lambda value in the context of a torque orientated engine control such as an electronic throttle flap positioning control.

The fuel-metering signal formed in accordance with the invention corresponds to a lambda desired value already present in the control apparatus. Stated otherwise, the lambda value, which results from a plurality of possible corrections of the fuel-metering signal, does not have to be computed anymore. From this, a reduced computer loading results which is of special advantage especially for control apparatus which execute computation time intensive diagnostic functions.

BRIEF DESCRIPTION OF THE DRAWINGS

The invention will now be explained with reference to the drawings wherein:

FIG. 1 is a schematic showing an embodiment of the invention in the form of a function block diagram;

DESCRIPTION OF THE PREFERRED EMBODIMENTS OF THE INVENTION

Figure 2:
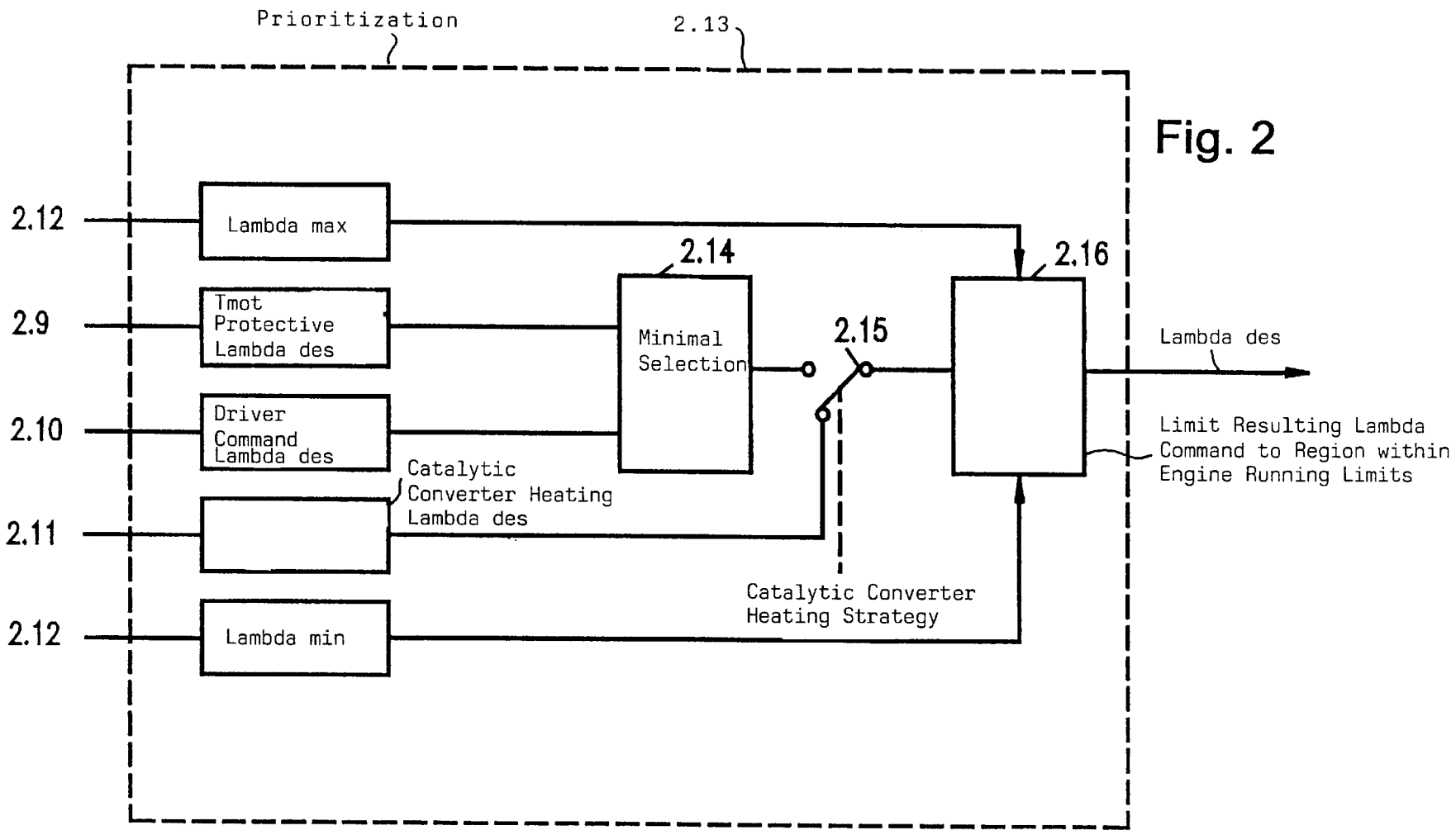
FIG. 2 is a schematic showing the feature of the prioritization according to the invention; and, FIG. 3 is a schematic showing how an unwanted enriching reaction of the lambda control is avoided.

In FIG. 1, block 1 represents the sensor means as a sum of the sensors of an internal combustion engine. These sensors supply signals to the control apparatus 2 as to operating parameters of the engine such as engine rpm (n), intake air mass flow mL, coolant temperature Tmot, lambda actual value, et cetera. In block 2.1, a signal rl for the air charge in the cylinder of the engine is formed from a portion of these signals. The signal rl together with the number of cylinders into which air flows into the engine represents a first signal for the formation of the fuel-metering signal.

The blocks 2.2 to 2.4, in turn, form corrective factors (fgk1, fgk2, fgk) from a portion of the sensor signals. These corrective factors are, for example, multiplicatively, logically coupled with the signal rl to fuel-metering signal te$\lambda$1 (for $\lambda=1$). The signal te$\lambda$1 corresponds therefore to a signal which is formed on the basis of the first signal for the air quantity flowing into the engine in such a manner that, with its use as a fuel-metering signal, a first lambda desired value adjusts. Examples of the above-mentioned corrective quantities are: corrective factors for a restart enrichment, or a warm-up running enrichment or an acceleration enrichment, a wall film correction as well as the control factor made available by the lambda control.

Insofar as explained to this point, the signal processing corresponds to known systems. In the state of the art, a comparable te$\lambda$1 is used directly for driving a fuel-metering device 2.8, for example, an injection valve arrangement. Here, further mixture corrections (as may be required) from the function blocks: catalytic converter heating, driver command, et cetera are cumulatively logically coupled with the signal rl, that is, simultaneously.

In contrast to the state of the art, various second lambda desired values are formed in the function blocks 2.9 to 2.12 and different objectives can be respectively pursued. For this purpose, signals of the sensor means 1 are likewise supplied to the function blocks 2.9 to 2.12.

The overheating protective block 2.9 can model the temperatures of different parts of the system in dependence upon input parameters and when reaching a critical temperature value, can request a rich lambda desired command because an enrichment is known to provide a cooling effect. Temperature critical components are, for example, the outlet valves, the exhaust-gas elbow or the catalytic converter. The temperature of these parts can also be measured.

The function block 2.10 targets to an optimization of the lambda desired value while taking into consideration the driver command. For example, block 2.10 can output a lean desired value in the part-load area in order to optimize consumption and, in the full-load area, input a rich lambda value when the driver commands full load.

A slightly lean mixture can, for example, be purposeful for a rapid heating of the catalytic converter to its operating temperature. Under corresponding conditions, the block 2.11 outputs a lambda desired command $\lambda des1>1$.

Block 2.12 serves as a further example of a function block for a lambda desired value input. Block 2.12 outputs an upper lambda value and a lower lambda value as running limits of the engine. These limit values define a permitted range and, outside of this range, problems can occur with respect to the combustion. These limit values are, for example, dependent upon the engine temperature.

According to the invention, from these lambda desired values, that value is selected which has the highest priority for the actual peripheral conditions. This takes place in block 2.13. The reciprocal value of the lambda desired value command of the highest priority is then logically coupled with the fuel-metering signal in block 2.14 for $\lambda=1$. For example, if the driver command for full power has the highest priority, then block 2.13 outputs the reciprocal value of the lambda desired value<1 commanded by block 2.9. An increase of the fuel-metering signal results by a multiplication of the fuel-metering signal for $\lambda=1$ with the reciprocal value of the lambda desired value<1. In this way, the enrichment, which is wanted in the example, is achieved via a lengthening of the injection pulse widths.

FIG. 2 shows an embodiment of the prioritization achieved with the method of the invention. The lower value (rich mixture) is selected in block 2.14 from the lambda command of the driver and from the overheat protection. This minimum selection is disregarded when the catalytic converter commands a slightly lean mixture for heating.

Figure 3:
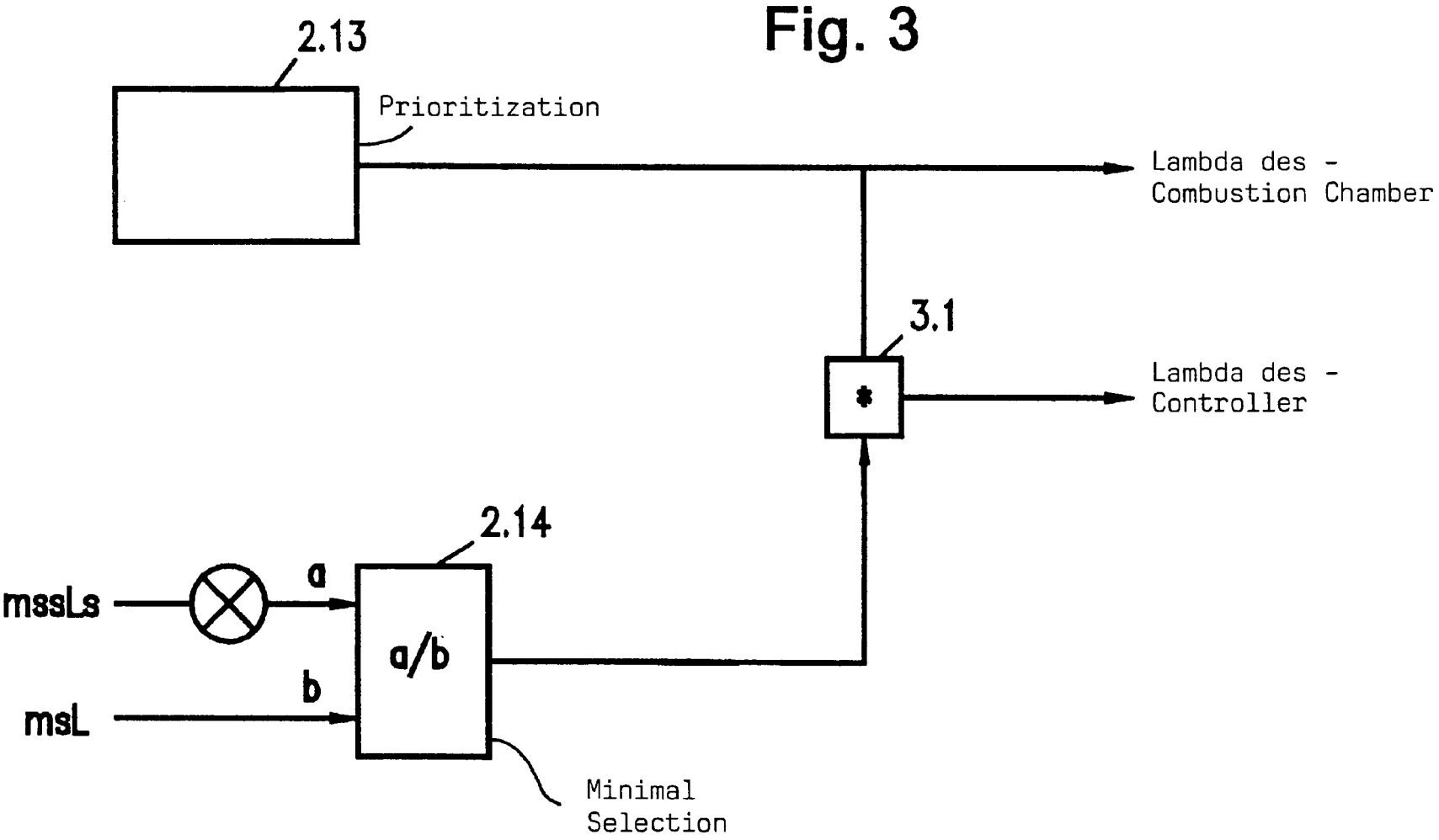

In FIG. 3, the above corresponds to the switchover from the output of block 2.14 to block 2.11 via the switch 2.15 which is driven by the command of a catalytic converter heating function. For a cold catalytic converter, the elbow cannot be too hot simultaneously. A lambda command for engine protection must, in this case, not be considered. The resulting lambda command is then limited to the running region of the engine. This takes place in block 2.16. The lambda values of the running limits lambda max and lambda min from blocks 2.12 are additionally supplied to block 2.16. The resulting lambda at the output of block 2.16 likewise forms the output value of the block 2.13 and influences the formation of the fuel-metering signal as shown in FIG. 1.

The embodiment described up to now is based on the assumption of a two-point lambda control to $\lambda=1$. For this control type, the control is switched off when a $\lambda\neq1$ is to be adjusted. In the structure of FIG. 1, this corresponds to the output of a fixed value in lieu of an actuating quantity fgk aiming at $\lambda=1$.

The adjustment of lambda values unequal to 1 results in the illustrated embodiment by logically coupling the fuel-metering signal for $\lambda=1$ and the reciprocal value of the desired value which deviates from $\lambda=1$ and was selected by the prioritization.

When utilizing bandwidth controls (that is, controls which are suitable also for desired values $\lambda\neq1$), the control can continue to process with a changed desired value. In this case, the desired value is logically coupled not only to the first fuel-metering signal but the desired value is supplied to a lambda controller in parallel as a new desired value.

A further modification of the lambda desired value for the controller is then necessary only for the case of the supply of secondary air behind the outlet valves of the engine. In this case, the wide band probe, which is mounted rearward of the engine, sees another lambda than present in the combustion chamber or which should be present in the combustion chamber. The desired value for the controller must be correspondingly corrected because the signal of the wide band probe serves for control. The wide band probe registers a lambda actual value when, for example, the air quantity msl is supplied to the engine and the additional secondary air quantity mssls is supplied to the exhaust gas. This lambda actual value corresponds to a total air quantity (msl+mssls). The lambda, which is registered by the wide band probe, is greater than the lambda in the combustion chamber by the factor (msl+mssls)/msl. The lambda in the combustion chamber was determined for the air mass msl. In order to here avoid an unwanted enrichment reaction of the lambda controller, the desired value for the lambda controller is likewise increased by the factor (msl+mssls)/msl.

The above is shown in FIG. 3. The output signal of the block 2.13 serves as a lambda desired value for the combustion chamber for the formation of the fuel-metering signal. In block 3.1, the lambda desired for the combustion chamber is converted to a desired value for the lambda desired controller by multiplication by a factor a/b.

The conversion factor a/b results as a sum of the intake air mass msl and the secondary air mass mssLs divided by the intake air mass msL.

It is understood that the foregoing description is that of the preferred embodiments of the invention and that various changes and modifications may be made thereto without departing from the spirit and scope of the invention as defined in the appended claims.

What is claimed is:

1. A method for computing a fuel-metering signal for adjusting a pregiven lambda value for the composition of the air/fuel mixture of an internal combustion engine, the method comprising the steps of:

forming a first signal which represents the air quantity flowing into said engine;

forming a second signal on the basis of said first signal so that a first lambda desired value adjusts when using said second signal as a fuel-metering signal;

forming various additional second lambda desired values as a function of operating parameters of said engine;

making a selection of those second lambda desired values having the highest priority; and, forming said fuel-metering signal by weighting said second signal with the second lambda desired value of the highest priority.

2. The method of claim 1, comprising the further steps of:

basing respective second lambda desired values on the following:

the command of the driver;

the necessity of an overheat protection;

a heating strategy for the catalytic converter; and, a requirement for maintaining the running limits of said engine.

3. The method of claim 1, comprising the further step of forming said fuel-metering signal while computing in at least one corrective quantity (fgk) which is such that said first lambda desired value adjusts without weighting said second signal with said second lambda desired value of the highest priority.

4. The method of claim 1, wherein said first lambda desired value corresponds to the stoichiometric air/fuel ratio.

5. The method of claim 1, comprising the further step of computing said at least one corrective quantity multiplicatively into said fuel-metering signal.

6. The method of claim 2, comprising the further step of arranging the various lambda desired values with increasing priority in accordance with the following sequence when prioritizing:

assigning the higher priority to the smaller of the two lambda desired values for the engine protection and the driver command;

assigning a higher priority to the lambda desired value of a catalytic converter heating strategy; and, limiting the resulting lambda desired value to an upper limit value and a lower limit value.

* * * * *